US005095778A

United States Patent [19]

Bocsi et al.

[11] Patent Number: 5,095,778

[45] Date of Patent: Mar. 17, 1992

[54] ELECTRIC CORK SCREW

[76] Inventors: Sandor Bocsi, 837 Grove St., Worcester, Mass. 01605; George Spector, 233 Broadway, Rm. 3815, New York, N.Y. 10007

[21] Appl. No.: 654,053

[22] Filed: Feb. 12, 1991

[51] Int. Cl.[5] ..... B67B 7/04

[52] U.S. Cl. ..... 81/3.2; 81/3.29; 81/3.45

[58] Field of Search ..... 81/3.2, 3.29, 3.33, 81/3.45, 3.25, 3.31, 3.32, 3.36

[56] References Cited

U.S. PATENT DOCUMENTS 4,637,283 1/1987 Bertram et al. ..... 81/3.2
4,955,261 9/1990 Chiang ..... 81/3.2

FOREIGN PATENT DOCUMENTS 0129301 12/1984 European Pat. Off. ..... 81/3.29
2608143 6/1988 France ..... 81/3.2
2199813 7/1988 United Kingdom ..... 81/3.2

*Primary Examiner*—Roscoe V. Parker

[57] ABSTRACT

An electric corkscrew device is provided and consists of a reversible electric motor having a stationary collar and a rotatable shaft. A first sleeve is coupled to the stationary collar of the reversible electric motor, a second sleeve is slideable within the first sleeve, in which the second sleeve is formed to cooperate with a bottle neck provided with a cork. A spring is within the first sleeve to urge the second sleeve towards the bottle neck. A corkscrew spiral is driven by the rotatable shaft of the reversible electric motor and extends through the first sleeve and the second sleeve so that when the corkscrew spiral turns in one direction it can engage the cork and pull it out of the bottle neck. A mechanism is for removing the cork from the corkscrew spiral when the rotatable shaft is reversed by the reversible electric motor and the corkscrew spiral turns in an opposite direction.

4 Claims, 1 Drawing Sheet

ELECTRIC CORK SCREW

BACKGROUND OF THE INVENTION

The instant invention relates generally to corkscrews and more specifically it relates to an electric corkscrew device which provides a corkscrew spiral which penetrates and extracts a cork from a bottle by a reversible electric motor.

There are available various conventional corkscrews which do not provide the novel improvements of the invention herein disclosed.

SUMMARY OF THE INVENTION

A primary object of the present invention is to provide an electric corkscrew device that will overcome the shortcomings of the prior art devices.

Another object is to provide an electric corkscrew device that is fully automated so that a corkscrew spiral in the device can rotate to correctly remove a cork from a bottle and then have its rotation reversed to remove the cork therefrom.

An additional object is to provide an electric corkscrew device that can include a holder mounted to a wall so that the device can be retained thereon and operated to remove the cork from a bottle.

A further object is to provide an electric corkscrew device that is simple and easy to use.

A still further object is to provide an electric corkscrew device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
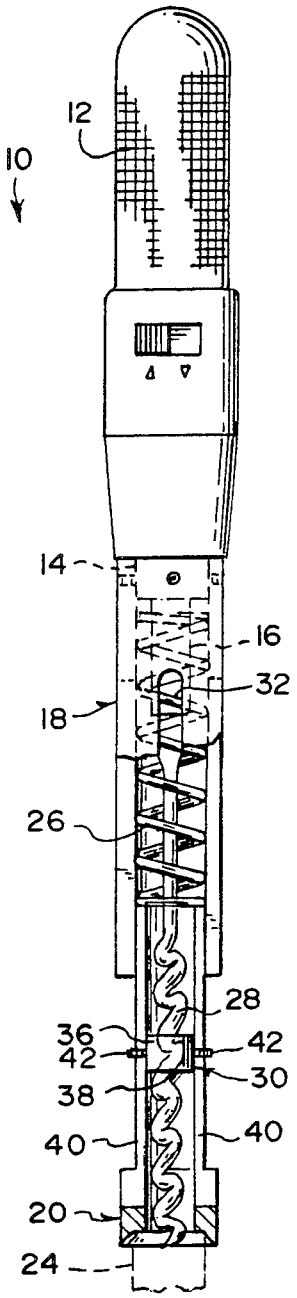
FIG. 1 is an elevational view of the instant invention with parts broken away.

Turning now descriptively to the drawings, in which similar reference characters denote similar elements throughout the several views, the Figures illustrate an electric corkscrew device 10 consisting of a reversible electric motor 12 having a stationary collar 14 and a rotatable shaft 16. A first sleeve 18 is coupled to the stationary collar 14 of the reversible electric motor 12. Second sleeve 20 is slideable within the first sleeve 18. The second sleeve 20 is formed to cooperate with a bottle neck 22 provided with a cork 24. Spring 26 is within the first sleeve 18 to urge the second sleeve 20 towards the bottle neck 22. A corkscrew spiral 28 is driven by the rotatable shaft 16 of the reversible electric motor 12 and extends through the first sleeve 18 and the second sleeve 20 so that when the corkscrew spiral 28 turns in one direction it can engage the cork 24 and pull it out of the bottle neck 22. A mechanism 30 is for removing the cork 24 from the corkscrew spiral 28 when the rotatable shaft 16 is reversed by the reversible electric motor 12 and the corkscrew spiral 28 turns in an opposite direction.

Figure 5:
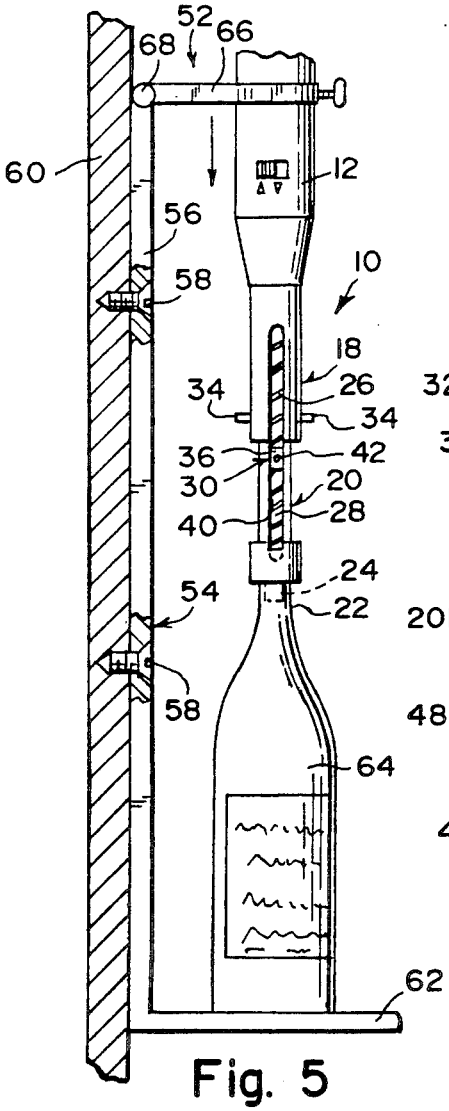
FIG. 5 is a side view of a holder mounted to a wall to retain the instant invention therein to remove the cork from the bottle.

The cork removing mechanism 30, as shown in FIGS. 1 and 5, includes the first sleeve 18 having a pair of elongated longitudinal slots 32 formed oppositely from each other. A first pair of threaded pins 34, are provided with each extending from the upper end of the second sleeve 20 and through one of the slots 32 in the first sleeve 18 so as to prevent the second sleeve 20 from rotating within the first sleeve 18.

A guide member 36 is threaded onto the corkscrew spiral 28 within the second sleeve 20. The guide member 36 has at least one downwardly pointed retainer 38 to contact the top of the cork 24. The second sleeve 20 has a pair of elongated longitudinal slots 40 formed oppositely from each other and positioned one hundred and eighty degrees from the elongated longitudinal slots 32 in the first sleeve 18. A second pair of threaded pins 42, are also provided in which each extends from an opposite side of the guide member 36 and through one of the slots 40 in the second sleeve 20 so as to prevent the guide member 36 from rotating thereabout. When the rotatable shaft 16 is reversed by the reversible electric motor 12 and the corkscrew spiral 28 turns in the opposite direction, the guide member 36 will push the cork 24 off of the corkscrew spiral 28.

Figure 2:
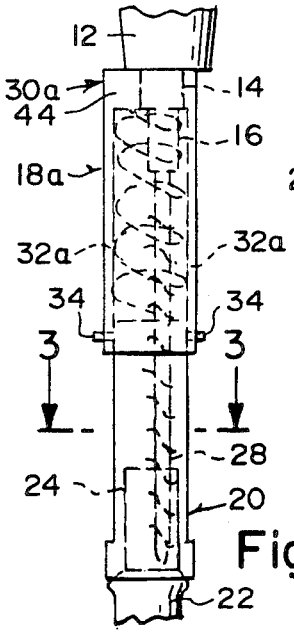
FIG. 2 is an elevational view of a first modification with parts broken away showing an off center corkscrew spiral therein.
Figure 3:
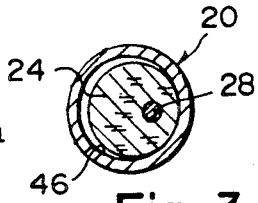
FIG. 3 is a cross sectional view taken along line 3—3 in FIG. 2.

FIGS. 2 and 3 show a first modified cork removing mechanism **30*a* that includes the first sleeve 18*a* having a top off center collar 44 and a pair of elongated longitudinal slots 32*a* formed oppositely from each other. The top off center collar 44 is coupled to the stationary collar 14 of the reversible electric motor so that the corkscrew spiral 28 will enter off center into the cork. A pair of threaded pins 34 are also provided in which each extends from the upper end of the second sleeve 20 and through one of the slots 32*a* in the first sleeve 18 to prevent the second sleeve 20 from rotating within the first sleeve 18*a*. When the rotatable shaft 16 is reversed by the reversible electric motor 12 and the corkscrew spiral 28 turns in the opposite direction the cork 24 will be pushed into the inner side 46 of the second sleeve 20 to prevent rotation of the cork 24 so it will come off of the corkscrew spiral 28**.

Figure 4:
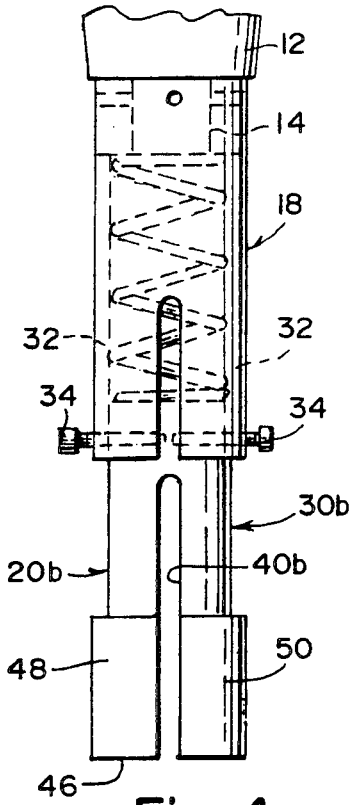
FIG. 4 is an elevational view of a second modification with parts broken away showing a flexible second sleeve for gripping the cork after removal from the bottle.

FIG. 4 shows a second modification wherein the cork removing mechanism **30*b* includes the first sleeve 18 having a pair of elongated longitudinal slots 32 formed oppositely from each other. A pair of threaded pins 34, are provided in which each extends from the upper end of the second sleeve 20*b* and through one of the slots 32 in the first sleeve 18 so as to prevent the second sleeve 20*b* from rotating within the first sleeve 18. The second sleeve 20*b* having a pair of elongated slits 40*b* formed oppositely from each other, extending up the bottom edge 46 of the second sleeve 20*b* and positioned one hundred and eighty degrees from the elongated longitudinal slots 32 in the first sleeve 18 to split most of the second sleeve 20*b* into two flexible segments 48 and 50**.

When the rotatable shaft 16 is reversed by the reversible electric motor 12 and the corkscrew spiral 28 turns in the opposite direction a person can squeeze the two flexible segments 48 and 50 together to grip the cork 24 so it will come off of the corkscrew spiral 28.

FIG. 5 shows a holder 52 that includes a L-shaped bracket member having a long leg 56 mounted by fastener 58 to a flat vertical structure 60 and a short leg 62 for supporting the bottle 64 thereon. A clamp member 66 is pivotly mounted at 68 to the top of the long leg 56 of the bracket member 54 to retain the reversible electric motor 12 thereto, so that the second sleeve 20 can face downward onto the neck 22 of the bottle 64 for the device 10 to remove the cork 24 from the bottle 64.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An electric corkscrew device comprising:

a) a reversible electric motor having a stationary collar and a rotatable shaft;

b) a first sleeve coupled to the stationary collar of said reversible electric motor;

c) a second sleeve, slideable within said first sleeve, said second sleeve formed to cooperate with a bottle neck provided with a cork;

d) a spring within said first sleeve to urge said second sleeve towards the bottle neck;

e) a corkscrew spiral driven by the rotatable shaft of said reversible electric motor and extending through said first sleeve and said second sleeve so that when said corkscrew spiral turns in one direction it can engage the cork and pull it out of the bottle neck; and f) means for removing the cork from said corkscrew spiral when the rotatable shaft is reversed by said reversible electric motor and said corkscrew turns in an opposite direction, wherein said cork removing means includes:

g) said first sleeve having a pair of elongated longitudinal slots formed oppositely from each other;

h) a first pair of threaded pins, each extending from the upper end of said second sleeve and through one of said slots in said first sleeve so as to prevent said second sleeve from rotating within said first sleeve;

i) a guide member threaded onto said corkscrew spiral within said second sleeve, said guide member having at least one downwardly pointed retainer to contact the top of the cork;

j) said second sleeve having a pair of elongated longitudinal slots formed oppositely from each other and positioned one hundred and eighty degrees from said elongated longitudinal slots in said first sleeve; and k) a second pair of threaded pins, each extending from an opposite side of said guide member and through one of said slots in said second sleeve so as to prevent said guide member from rotating thereabout so that when the rotatable shaft is reversed by said reversible electric motor and said corkscrew spiral turns in the opposite direction, said guide member will push the cork off of said corkscrew spiral.

2. An electric corkscrew device comprising:

a) a reversible electric motor having a stationary collar and a rotatable shaft;

b) a first sleeve coupled to the stationary collar of said reversible electric motor;

c) a second sleeve, slideable within said first sleeve, said second sleeve formed to cooperate with a bottle neck provided with a cork;

d) a spring within said first sleeve to urge said second sleeve towards the bottle neck;

e) a corkscrew spiral driven by the rotatable shaft of said reversible electric motor and extending through said first sleeve and said second sleeve so that when said corkscrew spiral turns in one direction it can engage the cork and pull it out of the bottle neck; and f) means for removing the cork from said corkscrew spiral when the rotatable shaft is reversed by said reversible electric motor and said corkscrew spiral turns in an opposite direction; wherein said cork removing means includes:

g) said first sleeve having a top off center collar and a pair of elongated longitudinal slots formed oppositely from each other, said top off center collar is coupled to the stationary collar of said reversible electric motor, so that said corkscrew spiral will enter off center into the cork;

h) a pair of threaded pins, each extending from the upper end of said second sleeve and through one of said slots in said first sleeve to prevent said second sleeve from rotating within said first sleeve, so that when the rotatable shaft is reversed by said reversible electric motor and said corkscrew spiral turns in the opposite direction the cork will be pushed into the inner side of said second sleeve to prevent rotation of the cork so it will come off of said corkscrew spiral.

3. An electric corkscrew device comprising:

a) a reversible electric motor having a stationary collar and a rotatable shaft;

b) a first sleeve coupled to the stationary collar of said reversible electric motor;

c) a second sleeve, slideable within said first sleeve, said second sleeve formed to cooperate with a bottle neck provided with a cork;

d) a spring within said first sleeve to urge said second sleeve towards the bottle neck;

e) a corkscrew spiral driven by the rotatable shaft of said reversible electric motor and extending through said first sleeve and said second sleeve so that when said corkscrew spiral turns in one direction it can engage the cork and pull it out of the bottle neck; and f) means for removing the cork from said corkscrew when the rotatable shaft is reversed by said reversible electric motor and said corkscrew spiral turns in an opposite direction, wherein said cork removing means includes:

g) said first sleeve having a pair of elongated longitudinal slots formed oppositely from each other;

h) a pair of threaded pins, each extending from the upper end of said second sleeve and through one of said slots in said first sleeve so as to prevent said second sleeve from rotating within said first sleeve;

i) said second sleeve having a pair of elongated slots formed oppositely from each other, extending up the bottom edge of said second sleeve and positioned one hundred and eighty degrees from said elongated longitudinal slots in said first sleeve to split most of said second sleeve into two flexible segments so that when the rotational shaft is reversed by said reversible electric motor and said corkscrew spiral turns in the opposite direction a person can squeeze the two flexible segments together to grip the cork so it will come off of said corkscrew spiral.

4. An electric corkscrew device comprising:

a) a reversible electric motor having a stationary collar and a rotatable shaft;

b) a first sleeve coupled to the stationary collar of said reversible electric motor;

c) a second sleeve, slideable within said first sleeve, said second sleeve formed to cooperate with a bottle neck provided with a cork;

d) a spring within said first sleeve to urge said second sleeve towards the bottle neck;

e) a corkscrew spiral driven by the rotatable shaft of said reversible electric motor and extending through said first sleeve and said second sleeve so that when said corkscrew spiral turns in one direction it can engage the cork and pull it out of the bottle neck; and f) means for removing the cork from said corkscrew spiral when the rotatable shaft is reversed by said reversible electric motor and said corkscrew spiral turns in an opposite direction, further comprising a holder that includes:

g) an L-shaped bracket member having a long leg mounted to a flat vertical structure and a short leg for supporting the bottle thereon; and h) a clamp member pivotly mounted to the top of the long leg of said bracket member to retain said reversible electric motor thereto, so that said second sleeve can face downward onto the neck of the bottle for said device to remove the cork from the bottle.

* * * * *